US011732402B1

(12) United States Patent
Xie

(10) Patent No.: US 11,732,402 B1
(45) Date of Patent: Aug. 22, 2023

(54) FOLDABLE IRONING BOARD

(71) Applicant: Guangdong Wireking Household Supplies Co. Ltd., Foshan (CN)

(72) Inventor: Jiawei Xie, Foshan (CN)

( * ) Notice: Subject to any disclaimer, the term of this patent is extended or adjusted under 35 U.S.C. 154(b) by 0 days.

(21) Appl. No.: 17/717,172

(22) Filed: Apr. 11, 2022

(30) Foreign Application Priority Data

Feb. 10, 2022 (CN) ..... 202220275840.9

(51) Int. Cl.
*D06F 81/02* (2006.01)

(52) U.S. Cl.
CPC ..... *D06F 81/02* (2013.01)

(58) Field of Classification Search
CPC ..... D06F 83/00
See application file for complete search history.

(56) References Cited

U.S. PATENT DOCUMENTS 1,709,927 A * 4/1929 Whitney ..... A47B 3/0815 108/18
2,554,446 A * 5/1951 Nestor ..... A47B 35/00 38/139
3,699,673 A * 10/1972 Foster ..... A47B 35/00 38/104
4,565,021 A * 1/1986 Kay ..... D06F 81/02 248/439
4,986,395 A * 1/1991 Lewis ..... A45C 9/00 190/18 R
4,991,325 A * 2/1991 Teduschi ..... D06F 81/04 38/103
5,655,623 A * 8/1997 Skyba ..... E06C 1/381 182/100
5,974,980 A * 11/1999 Kent ..... A47B 77/10 108/42
7,040,048 B2 * 5/2006 Delery ..... D06F 81/02 38/139
8,893,411 B2 * 11/2014 Cocksedge ..... D06F 81/10 108/116

* cited by examiner

*Primary Examiner* — Ismael Izaguirre

(57) ABSTRACT

The present disclosure provides a foldable ironing board. The foldable ironing board includes a panel, a support foot, and a sliding support member. The panel includes a first panel and a second panel in a mutually movable connection. The support foot includes a first support foot and a second support foot arranged opposite each other; wherein the first support foot extends along a length direction of a bottom of the first panel, and the second support foot extends along a length direction of a bottom of the second panel. An end of the first support foot and an end of the second support foot, that are opposite to each other, are in a mutually movable connection through the sliding support member. The sliding support member is capable of sliding reciprocally along an extension direction of the first support foot and the second support foot.

10 Claims, 9 Drawing Sheets

FOLDABLE IRONING BOARD

TECHNICAL FIELD

The present disclosure relates to the field of household goods technologies, and in particular to a foldable ironing board.

BACKGROUND

An ironing board is a living appliance used for flattening people's clothing, and is widely used in modern life, both in professional garment companies and in individual households. There are a variety of ironing boards in the existing market, and most of them have integral and non-foldable panels, and their support feet are fixed to the panels. Such integral panels and fixed connected support feet are not movable and adjustable. With the development of people's life needs and technology, people made updates and improvements to the ironing board. The panel of the ironing board is foldable, and the support feet and the panel are movable and adjustable. This ironing board can be easily carried and stored, saving occupied space.

However, for the existing foldable and movably adjustable ironing board, the operations of its panel folding and support feet adjustment are still too cumbersome and complicated. For example, two panels are only connected to each other through a simple support or connection structure and cannot provide an ironing board with solid structure and easy folding operation, resulting in unpleasant sense of use experience.

SUMMARY OF THE DISCLOSURE

In view of this, the purpose of the present disclosure is to solve the technical problems such as poor structure of the existing ironing board and inconvenient operation of the panel folding by providing a foldable ironing board.

To solve the above technical problems, the present disclosure provides a foldable ironing board, comprising:

a panel, comprising a first panel and a second panel in a mutually movable connection;

a support foot, comprising a first support foot and a second support foot arranged opposite each other; wherein the first support foot extends along a length direction of a bottom of the first panel, and the second support foot extends along a length direction of a bottom of the second panel; and a sliding support member, wherein an end of the first support foot and an end of the second support foot, that are opposite to each other, are in a mutually movable connection through the sliding support member; the sliding support member is capable of sliding reciprocally along an extension direction of the first support foot and the second support foot.

In some embodiments, a limiting part is arranged at the bottom of the first panel, and another limiting part is arranged at the bottom of the second panel; the sliding support member is arranged with a protruding edge and a protruding block on a side of the sliding support member facing the bottom of the first panel and the bottom of the second panel, the protruding edge and the protruding block being in a mutually positional limitation with the limiting parts.

In some embodiments, the protruding edge is arranged an end side of the sliding support member, and the protruding block is arranged on the other end side of the sliding support member, the limiting part of the first panel is disposed on an outer edge of the protruding edge, and the limiting part of the second panel is disposed between the protruding edge and the protruding block;

a sliding distance of the sliding support member is equal to a distance of a spacing between the limiting part of the first panel and the limiting part of the second panel.

In some embodiments, the first support foot comprises a plurality of first support feet arranged in parallel in a width direction of the bottom of the first panel, and the second support foot comprises a plurality of second support feet arranged in parallel in a width direction of the bottom of the second panel; the first support feet and the second feet foot are coaxially arranged relative to each other or non-coaxially arranged.

In some embodiments, a sleeve is arranged on each of two sides of the sliding support member; the end of the first support foot and the end of the second support foot, that are opposite to each other, are matchingly connected to the sleeve; one of the plurality of first support feet and a corresponding second support foot arranged coaxially opposite to each other are connected to a corresponding sleeve on the same side of the sliding support member.

In some embodiments, a slot is defined on each of two sides of the end of the first panel, and another slot is defined on each of two sides of the end of the second panel; the slot of the first panel and the slot of the second panel are movably connected to each other through a connection block.

In some embodiments, a connection hole is defined on each of two end sides of the connection block, and another connection hole is defined in the slot; the connection hole on an end side of the connection block is arranged opposite to a corresponding connection hole in a corresponding slot.

In some embodiments, wherein the first support foot is movably connected to the bottom of the first panel through a fixing member, the second support foot is movably connected to the bottom of the second panel through another fixing member; the fixing member comprises a plurality of fixing members arranged along the extension direction of the first support foot and the second support foot.

In some embodiments, an end of the first support foot away from the second support foot is bent, and an end of the second support foot away from the first support foot is bent; the first support foot and the second support foot are respectively connected to the fixing member for relative rotation and in an unfolded state or a storage state.

In some embodiments, the first panel and the second panel define a plurality of mesh holes penetrating the first panel and the second panel, are covered with a fabric layer, and further define a plurality of grid on the bottom of the first panel and the bottom of the second panel.

As can be seen from the above technical solutions, the present disclosure provides a foldable ironing board, by providing a first panel and a second panel that are movably connected to each other, and the first panel and the second panel are respectively connected with a first support foot and a second support foot, and the opposite ends of the first support foot and the second support foot are connected to each other by a sliding support member, and the sliding support member slides reciprocally along the extension direction of the first support foot and the second support foot. In this way, the rapid unfolding support and folding storage effect between the first panel and the second panel is realized, and the structural stability of the first panel, the second panel, the support foot and the sliding support member is effectively strengthened.

BRIEF DESCRIPTION OF THE DRAWINGS

To illustrate the technical solutions more clearly in the embodiments of the present disclosure, the following will be briefly described in the description of the embodiments required to use the attached drawings. It is obvious that the following description of the attached drawings are only some of the embodiments of the present disclosure, and those skilled in the art, without creative work, can also obtain other attached drawings based on these drawings.

In the drawings.

Figure 1:
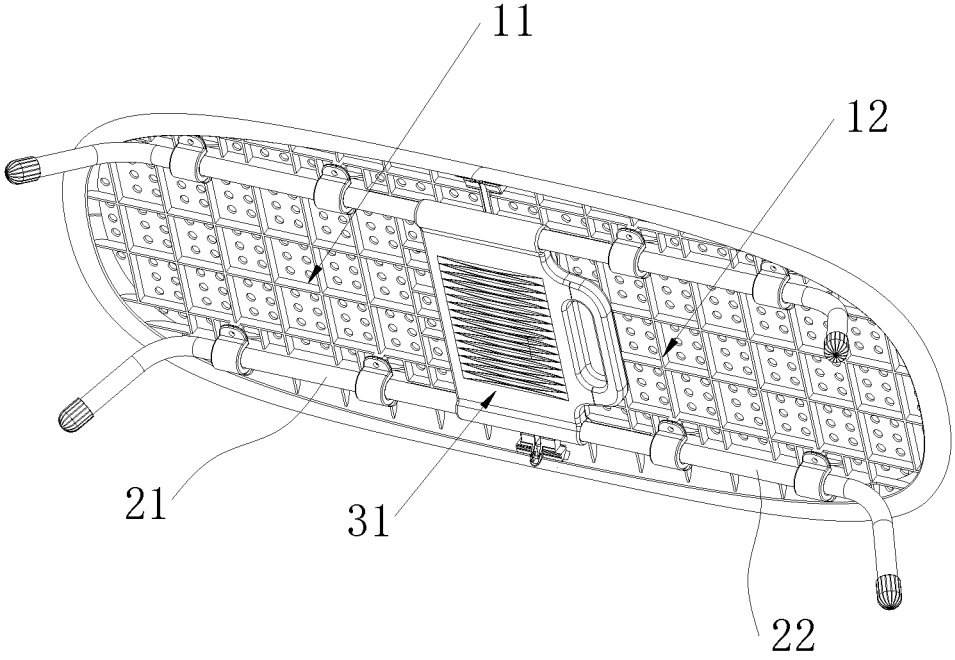
FIG. 1 is a perspective view of a foldable ironing board in a bottom direction according to an embodiment of the present disclosure.

11, first panel; 12, second panel; 131, slot; 14, connection block; 151, connection hole;

21, first support foot; 22, second support foot;

31, sliding support member; 311, protruding edge; 312, protruding block; 313, sleeve; 314, handle;

41, limiting part;

51, fixing member;

61, fabric layer.

DETAILED DESCRIPTION

The technical solutions in the embodiments of the present disclosure will be clearly and completely described below in conjunction with the accompanying drawings in the embodiments of the present disclosure. It will be understood that the specific embodiments described herein are for the purpose of explaining the present disclosure only, and not for the purpose of limiting the present disclosure. Based on the embodiment of the present disclosure, all other embodiments obtained by those skilled in the art without creative work fall within the scope of the present disclosure.

In the description of embodiments of the present disclosure, terms "center", "top", "bottom", "left", "right", "vertical", "horizontal", "inside", "outside" and the like indicate an orientation or positional relationship based on the orientation or positional relationship shown in the accompanying drawings, are intended only to facilitate and simplify the description of embodiments of the present disclosure, and are not intended to indicate or imply that the device or element referred to must have a particular orientation, be constructed and operate in a particular orientation, and therefore are not to be construed as limiting the embodiments of the present disclosure. Furthermore, the terms "first", "second", and "third" are used for descriptive purposes only and are not to be construed as indicating or implying relative importance.

In the description of embodiments of the present disclosure, it should be noted that, unless otherwise expressly specified and limited, the terms "mounted", "connected", "coupled" are to be understood in a broad sense, e.g., it may be a fixed connection, an interchangeable connection, or a one-piece connection, a mechanical connection, an electrical connection, a direct connection, an indirect connection through an intermediate medium, or a connection within two components. For those skilled in the art, the specific meaning of the above terms in the context of embodiments of the present disclosure can be understood in specific cases.

The present disclosure provides a foldable ironing board.

Referring to FIGS. 1-9, a foldable ironing board provided in the present disclosure includes a panel, a support foot and a sliding support member 31, and the panel mainly includes a first panel 11 and a second panel 12. The first panel 11 and the second panel 12 are in a mutually movable connection, and the mutually movable connection includes a variety of connection methods such as hinged, linked and belt connection. In some embodiments, the first panel 11 and the second panel 12 are panels arranged symmetrically with each other and of equal area. An end of the first panel 11 and an end of the second panel 12 are each flush, and the other end of the first panel 11 and the other end of the second panel 12 are each circular. The flush end of the first panel 11 and the flush end of the second panel 12 are arranged in opposite directions.

The support foot mainly includes a first support foot 21 and a second support foot 22 arranged opposite each other. That is, the first support foot 21 and the second support foot 22 are arranged in a non-alongside or non-parallel orientation on a same horizontal plane. Among them, the first support foot 21 is arranged at a bottom of the first panel 11. An end of the first support foot 21 extends along a length of the flush end of the first panel 11, and the other end of the first support foot 21 extends toward the circular end of the first panel 11, thereby making the first support foot 21 and the bottom of the first panel 11 substantially parallel to each other. The second support foot 22 is arranged at a bottom of the second panel 12. An end of the second support foot 22 extends along a length of the flush end of the second panel 12, and the other end of the second support foot 22 extends toward the circular end of the second panel 12, thereby making the second support foot 22 and the bottom of the second panel 12 substantially parallel to each other.

In some embodiments, since the first support foot 21 and the second support foot 22 are arranged opposite each other, the ends of the first support foot 21 and the second support foot 22 facing each other are movably connected by the sliding support member 31. The sliding support member 31 may be in a substantially plate-like structure and be arranged parallel to the first panel 11 and the second panel 12. In practical application, the sliding support member 31 is arranged at a bottom of an interconnection of the first panel 11 and the second panel 12. The sliding support member 31 may slide reciprocally along an extension direction of the first support foot 21 and the second support foot 22. Specifically, since the sliding support member 31 is connected to the ends of the first support foot 21 and the second support foot 22 facing each other, the sliding support member 31 slides back and forth between the ends of the first support foot 21 and the second support foot 22 facing each other. When the sliding support member 31 slides to a centering position at a connection of the first support foot 21 and the second support foot 22, the sliding support member 31 serves as an unfolding support for the first panel 11 and the second panel 12. When the sliding support member 31 slides completely to the flush end of the second support foot 22 extending to the second panel 12, the first panel 11 may be flipped and folded relative to the second panel 12, thereby realizing the purpose of unfolding and folding of the ironing board.

In this way, since the first panel 11 and the second panel 12 are movably connected to each other, the first panel 11 and the second panel 12 are connected to the first support foot 21 and the second support foot 22, respectively, and the ends of the first support foot 21 and the second support foot 22 facing each other are connected by the sliding support member 31, which slide reciprocally along the extension direction of the first support foot 21 and the second support foot 22, a rapid unfolding support and a folding for storage between the first panel 11 and the second panel 12 are realized, and the structural stability of the first panel 11, the second panel 12, the support foot and the sliding support member is effectively strengthened.

Figure 2:
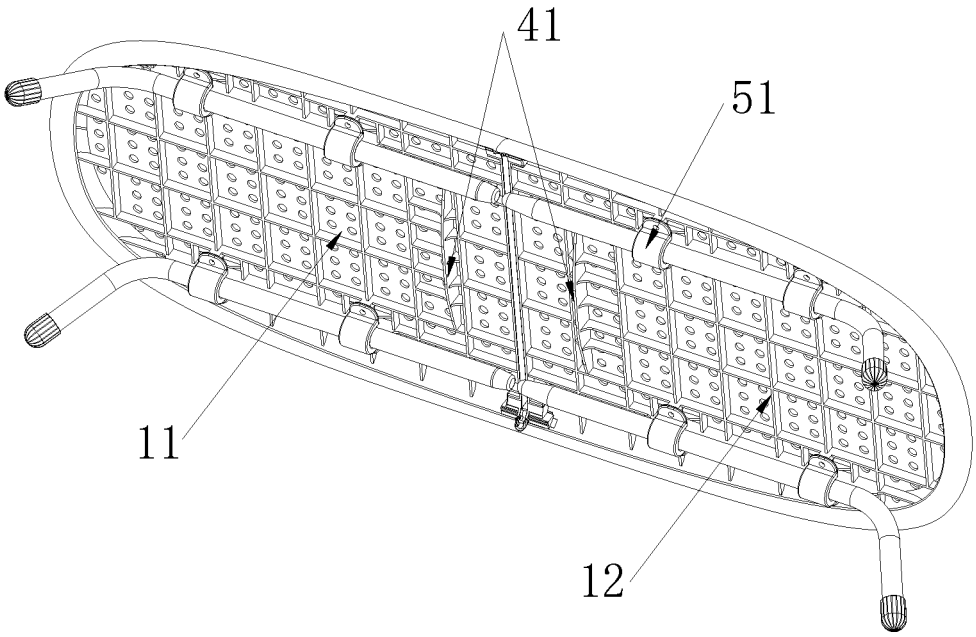
FIG. 2 is a perspective view of a foldable ironing board, with a sliding support member removed, in a bottom direction according to an embodiment of the present disclosure.
Figure 3:
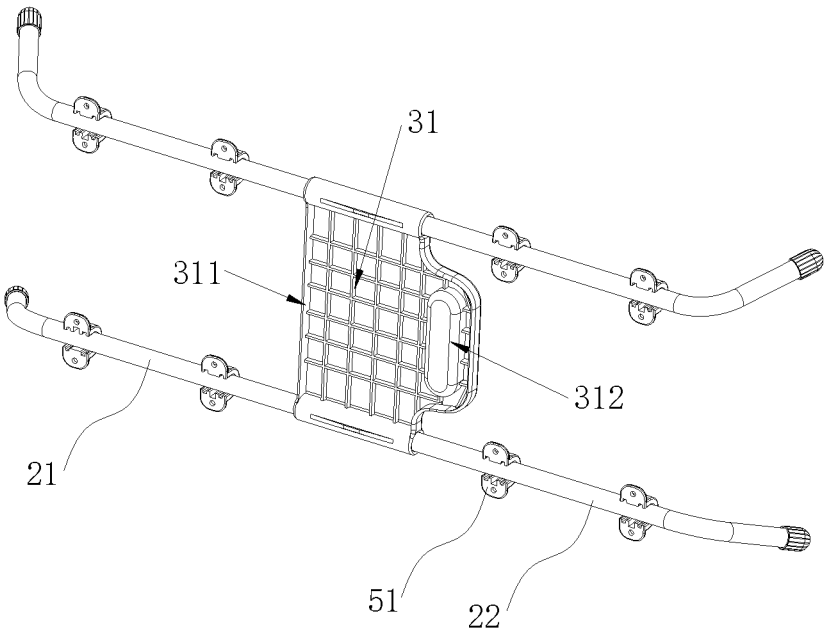
FIG. 3 is a perspective view of a sliding support member of a foldable ironing board, connected to a first support foot and a second support foot, in a top direction according to an embodiment of the present disclosure.

Referring to FIGS. 2-3, to achieve the position limitation between the sliding support member 31 and the first panel 11 as well as the second panel 12, and to facilitate adjusting the unfolding and storing between the first panel 11 and the second panel 12 by the sliding support member 31, a limiting part 41 may be arranged at the bottom of the first panel 11 and another limiting part 41 may be arranged at the bottom of the second panel 12, which are generally set in such a way that a protruding plate is arranged at the bottom of the first panel 11 and the bottom of the second panel 12 respectively. The sliding support member 31 is arranged with a protruding edge 311 and a protruding block 312 on a side of the sliding support member 31 facing the bottom of the first panel 11 and the bottom of the second panel 12, such that the protruding edge 311 and the protruding block 312 of the sliding support member 31 form a mutual limiting arrangement with the first panel 11 and the second panel 12, respectively, to achieve the effect of controlling within the sliding range of the sliding support member 31.

The design requirement for the adjustment of positional limitation between the sliding support member 31 and the first panel 11 as well as the second panel 12 is that the protruding edge 311 and the protruding block 312 of the sliding support member 31 are arranged on two end sides of the sliding support member 31, respectively, to be precise, the protruding edge 311 and the protruding block 312 of the sliding support member 31 are arranged on one side of the sliding support member 31 facing the first panel 11 and the second panel 12, and the protruding edge 311 and the protruding block 312 are provided on one side of the sliding support member 31 facing the first panel 11 and the second panel 12, respectively, and the protruding edge 311 and the protruding block 312 are arranged on the two ends of the sliding support member 31, respectively. The protruding edge 311 is set as a sheet structure that is protruding outward from the side of the sliding support member 31, and the protruding block 312 is set as a block structure that is protruding outward from the side of the sliding support member 31. The side of the sliding support member 31 with the protruding block is formed with a handle 314 that is convenient for the user to pull or push, and the handle is substantially deformed from the protruding block 312 on the side of the sliding support member 31. That is, the arrangement relationship between the limiting part 41 and the protruding edge 311 as well as the protruding block 312 is such that when the sliding support member 31 is assembled on the first support foot 21 and the second support foot 22, the limiting part 41 of the first panel 11 is disposed on an outer edge of the protruding edge 311 and the limiting part 41 of the second panel 12 is disposed between the protruding edge 311 and the protruding block 312.

In practical application, when the sliding support member 31 slides to a certain distance in the extension direction of the first support foot 21, an outer side of the protruding edge 311 collides with an inner side of the first panel 11, and an inner side of the protruding block 312 collides with an outer side of the second panel 12, so as to realize the limitation of the sliding range of the sliding support member 31 toward the first support foot 21; when the sliding support member 31 slides to a certain distance in the extension direction of the second support foot 22, an inner side of the protruding edge 311 collides with an inner side of the second panel 12, so as to realize the limitation of the sliding range of the sliding support member 31 toward the second support foot 22.

In this way, by reasonably setting the limit portions 41 of the first panel 11 and the second panel 12, and reasonably setting the protruding edge 311 and the protruding block 312 of the sliding support member 31, it is determined that the sliding distance of the sliding support member 31 can be limited by setting the spacing between the limit portions 41 of the first panel 11 and the limit portions 41 of the second panel 12.

In practical application, to improve the solid support effect of the support foot on the ironing board, the number of the first support feet 21 and that of the second support feet 22 may be set two each. The arrangement requirement for the first support feet 21 is that the two first support feet 21 are arranged at the bottom of the first panel 11, more specifically, the two first support feet 21 are arranged in parallel with each other. That is, the two first support feet 21 are arranged in parallel along the width direction of the first panel 11, so as to complete the arrangement relationship between the first support feet 21 and the first panel 11.

The arrangement requirement for the second support feet 22 is that the two second support feet 22 are arranged at the bottom of the second panel 12, more specifically, the two second support feet 22 are arranged in parallel with each other. That is, the two second support feet 22 are arranged in parallel along the width direction of the first panel 11, so as to complete the arrangement relationship between the second support feet 22 and the second panel 12.

In some embodiments, since two first support feet 21 and two second support feet 22 are arranged respectively, the first support feet 21 and the second support feet 22 are arranged coaxially or non-coaxially. More specifically, one first support foot 21 is arranged on one side of the first panel 11, and one second support foot 22 is arranged on a side of the second panel 12 in the same side direction as the first panel 11. In this way, the first support foot 21 of the first panel 11 and the second support foot 22 of the second panel 12 can be arranged coaxially. Of course, they can be arranged non-coaxially if designed not as above.

Figure 4:
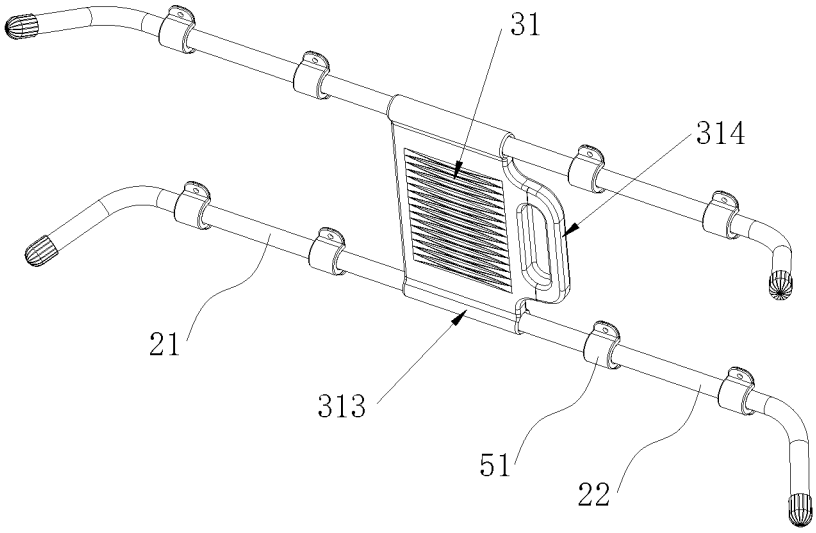
FIG. 4 is a perspective view of a sliding support member of a foldable ironing board, connected to a first support foot and a second support foot, in a bottom direction according to an embodiment of the present disclosure.

Referring to FIG. 4, in order to improve the convenience of the movable connection between the sliding support member 31 and the first support foot 21 as well as the second support foot 22, a sleeve 313 may be arranged on each side of the sliding support member 31, which is substantially circular and tubular in shape. The shape of the sleeve can be adjusted to match the shape of the support foot, which is not limited herein. In operation and use, the extended end of the first support foot 21 toward the flush end of the first panel 11 is inserted into a port of the sleeve 313, and the extended end of the second support frame toward the flush end of the second panel 12 is inserted into the other port of the sleeve 313. Or to say, the opposite ends of the first support foot 21 and the second support foot 22 are inserted into the two ports of the sleeve 313, thereby completing the matching connection between the first support foot 21, the second support foot 22, and the sleeve 313.

According to the above description, the first support foot 21 and the second support foot 22 are connected to the sleeve 313 on the same side of the sliding support member 31, so as to ensure that the sleeve 313 can slide smoothly and freely along the extension direction of the first support foot 21 and the second support foot 22, and also facilitate the convenient rotation of the first support foot 21 and the second support foot 22 inside the sleeve 313 and between fixing members 51. In this way, the first support foot 21 and the second support foot 22 can be freely and quickly expanded and stored.

Figure 5:
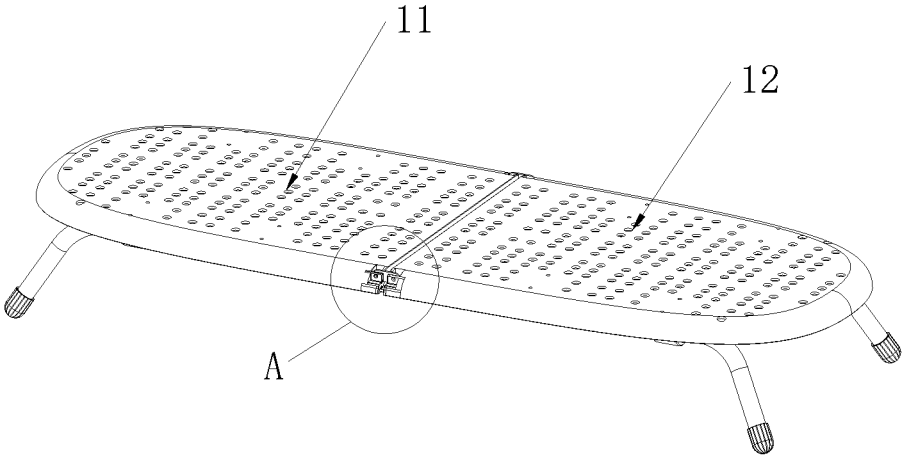
FIG. 5 is a perspective view of a foldable ironing board in a top direction according to an embodiment of the present disclosure.
Figure 6:
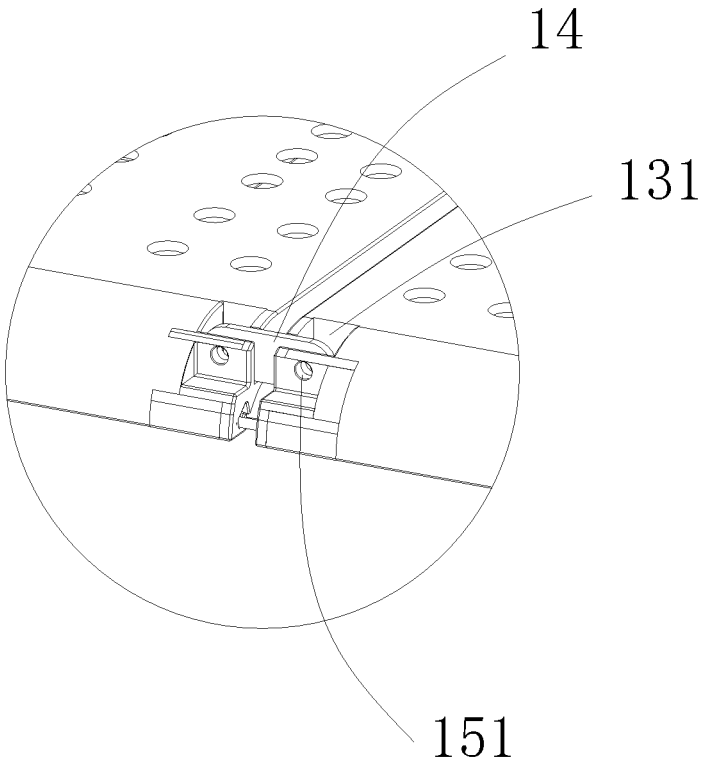
FIG. 6 is an enlarged view of an area A circumscribed in FIG. 5.

Referring to FIGS. 5-6, in order to realize the movable connection relationship between the first panel 11 and the second panel 12, a slot 131 may be defined on each side of the opposite ends of the first panel 11 and the second panel 12, which is mainly configured to assemble a connection block 14. The adopted connection block 14 may be of a substantial sheet structure. In this way, the slot 131 of the first panel 11 and the slot 131 of the second panel 12 can be movably connected to each other by the connection block 14. Or to say, the connection block 14 is hinged to the slot 131 of the first panel 11 and the slot 131 of the second panel 12.

In some embodiments, a connection hole 151 is defined on each end side of the connection block 14, and another connection hole 151 is defined in the slot 131. The connection hole 151 may be a round hole, and the connection hole 151 on the end side of the connection block 14 is arranged opposite to the connection hole 151 in the slot 131. The connection hole 151 of the connection block 14 and the connection hole 151 in the slot 131 may be connected in series by means of a shaft, such that a connection relationship of relative movable connection is formed between the connecting block 14 and the slot 131. In this way, the first panel 11 and the second panel 12 can be folded for storage and unfolded for use at will.

Referring to FIGS. 2-4, the design requirements for the connection relationship between the first support foot 21 and the first panel 11, and the connection relationship between the second support foot 22 and the second panel 12 are such that the first support foot 21 is movably connected to the bottom of the first panel 11 by the fixing member 51, and the second support foot 22 is movably connected to the bottom of the second panel 12 by the fixing member 51. The fixing member 51 may be of a circular or semi-circular hole shape, and the diameter of the hole of the fixing member 51 is greater than the diameter of the first support foot 21 and the second support foot 22, such that the first support foot 21 and the second support foot 22 can be rotated arbitrarily within the fixing member 51. By setting the multiple fixing member 51 along the extension direction of the first support foot 21 and the second support foot 22, the first support foot 21 and the second support foot 22 can be firmly connected to the bottom of the panel and improve the overall structural stability of the ironing board.

Figure 7:
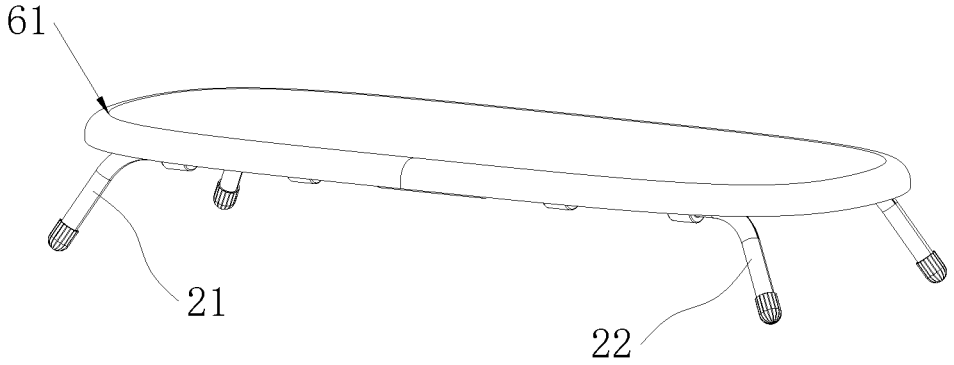
FIG. 7 is a perspective view of a foldable ironing board in a side direction according to an embodiment of the present disclosure.

Referring to FIG. 7, the first panel 11 and the second panel 12 may define a plurality of mesh holes penetrating the two to reduce the overall weight of the ironing board and save the cost of processing materials. The first panel 11 and the second panel 12 may be covered with a fabric layer 61, and the fabric layer may be made of a cloth material, so as to complete the panel decoration and to achieve the purpose of placing clothing for flat ironing. The first panel 11 and the second panel 12 may further define a plurality of grid on the bottom of the two to effectively improve the structural strength of the first panel 11 and the second panel 12, improving the durability performance.

Figure 8:
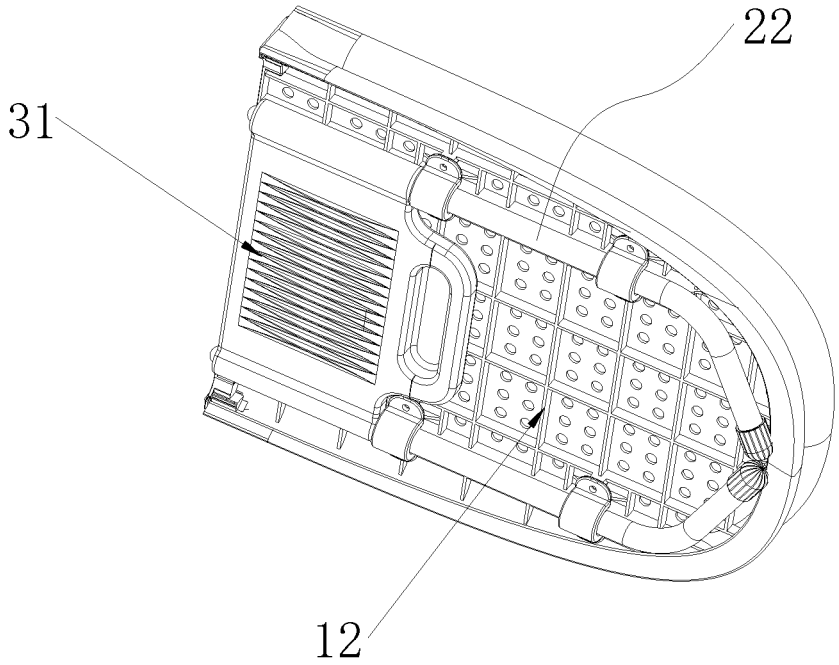
FIG. 8 is a perspective view of a foldable ironing board, in a folded state, in a direction with a second panel according to an embodiment of the present disclosure.
Figure 9:
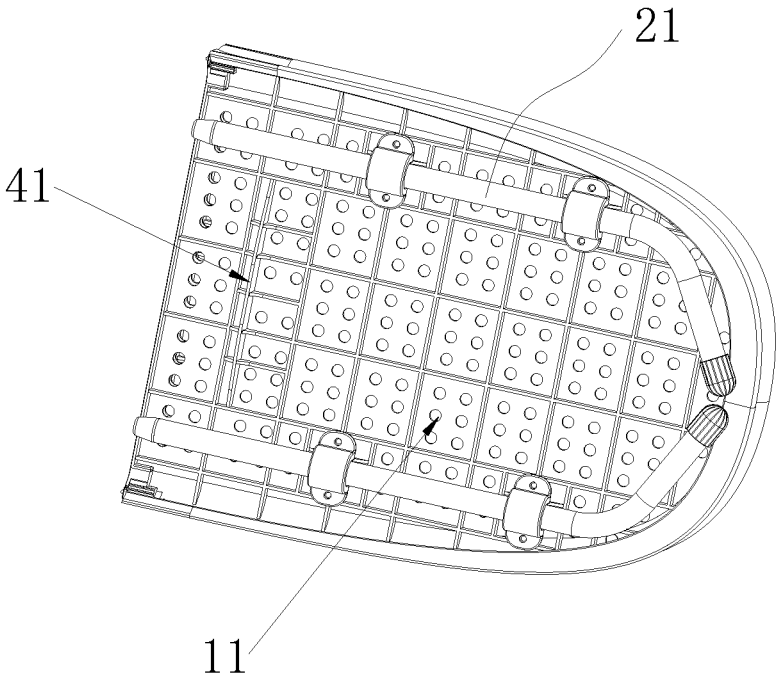
FIG. 9 is a perspective view of a foldable ironing board, in a folded state, in a direction with a first panel according to an embodiment of the present disclosure.

Referring to FIGS. 7-9, in order to achieve the effect of quick support use and convenient storage of the ironing board, an end of the first support foot 21 away from the second support foot 22 may be bent, and an end of the second support foot 22 away from the first support foot 21 may be bent. The first support foot 21 and the second support foot 22 are respectively connected to the fixing member 51 for relative rotation and in the unfolded state or storage state. More specifically, the bent ends of the first support foot 21 and the second support foot 22 is used as the ends for direct contact with the ground, or the landing ends. The landing ends of the first support foot 21 and the second support foot 22 may be arranged with a foot pad with non-slip tooth pattern. The first support foot 21 is movably linked to the first panel 11 through the fixing member 51, and the second support foot 22 is similarly movably linked to the second panel 12 through the fixing member 51.

In this way, the first support and the second support foot 22 can be freely rotated, that is, when the bent ends of the first support foot 21 and the second support foot 22 are rotated away from the panel side for the unfolded state, the support foot can support the panel; when the bent ends of the first support foot 21 and the second support foot 22 are rotated closer to the panel side for the storage state, the bent part of the support foot and the panel maintain a parallel arrangement relationship, playing the storage effect of the support foot, which is convenient to carry and store the ironing board.

The above is a detailed introduction of a foldable ironing board provided in the present disclosure. For those skilled in the art, according to the idea of the embodiments in the present disclosure, there will be changes in the specific implementation and application scope. In summary, the content of this specification should not be understood as a limitation of the present disclosure.

What is claimed is:

1. A foldable ironing board, comprising:

a panel, comprising a first panel and a second panel in a mutually movable connection;

a support foot, comprising a first support foot and a second support foot arranged opposite to each other; wherein the first support foot extends along a length direction of a bottom of the first panel, and the second support foot extends along a length direction of a bottom of the second panel; and a sliding support member, wherein an end of the first support foot and an end of the second support foot, that are opposite to each other, are in a mutually movable connection through the sliding support member; the sliding support member is capable of sliding reciprocally along an extension direction of the first support foot and the second support foot.

2. The foldable ironing board according to claim 1, wherein a limiting part is arranged at the bottom of the first panel, and another limiting part is arranged at the bottom of the second panel; the sliding support member is arranged with a protruding edge and a protruding block on a side of the sliding support member facing the bottom of the first panel and the bottom of the second panel, the protruding edge and the protruding block being in a mutually positional limitation with the limiting parts.

3. The foldable ironing board according to claim 2, wherein the protruding edge is arranged on an end side of the sliding support member, and the protruding block is arranged on the other end side of the sliding support member, the limiting part of the first panel is disposed on an outer edge of the protruding edge, and the limiting part of the second panel is disposed between the protruding edge and the protruding block;

a sliding distance of the sliding support member is equal to a distance of a spacing between the limiting part of the first panel and the limiting part of the second panel.

4. The foldable ironing board according to claim 1, wherein the first support foot comprises a plurality of first support feet arranged in parallel in a width direction of the bottom of the first panel, and the second support foot comprises a plurality of second support feet arranged in parallel in a width direction of the bottom of the second panel; the first support feet and the second feet foot are coaxially arranged relative to each other or non-coaxially arranged.

5. The foldable ironing board according to claim 4, wherein a sleeve is arranged on each of two sides of the sliding support member; the end of the first support foot and the end of the second support foot, that are opposite to each other, are matchingly connected to the sleeve; one of the plurality of first support feet and a corresponding second support foot arranged coaxially opposite to each other are connected to a corresponding sleeve on the same side of the sliding support member.

6. The foldable ironing board according to claim 1, wherein a slot is defined on each of two sides of the end of the first panel, and another slot is defined on each of two sides of the end of the second panel; the slot of the first panel and the slot of the second panel are movably connected to each other through a connection block.

7. The foldable ironing board according to claim 6, wherein a connection hole is defined on each of two end sides of the connection block, and another connection hole is defined in the slot; the connection hole on an end side of the connection block is arranged opposite to a corresponding connection hole in a corresponding slot.

8. The foldable ironing board according to claim 1, wherein the first support foot is movably connected to the bottom of the first panel through a fixing member, the second support foot is movably connected to the bottom of the second panel through another fixing member, the fixing member comprises a plurality of fixing members arranged along the extension direction of the first support foot and the second support foot.

9. The foldable ironing board according to claim 8, wherein an end of the first support foot away from the second support foot is bent, and an end of the second support foot away from the first support foot is bent; the first support foot and the second support foot are respectively connected to the fixing member for relative rotation and in an unfolded state or a storage state.

10. The foldable ironing board according to claim 1, wherein the first panel and the second panel define a plurality of mesh holes penetrating the first panel and the second panel, are covered with a fabric layer, and further define a plurality of grid on the bottom of the first panel and the bottom of the second panel.

* * * * *